United States Patent [19]

Miller et al.

[11] Patent Number: 4,709,126

[45] Date of Patent: Nov. 24, 1987

[54] PRESSURE SWITCH WITH ROLLING DIAPHRAGM

[75] Inventors: Larry G. Miller, Montgomery; Harold E. Whiting; Dale Willcox, both of St. Charles, all of Ill.

[73] Assignee: Furnas Electric Company, Batavia, Ill.

[21] Appl. No.: 914,622

[22] Filed: Oct. 2, 1986

[51] Int. Cl.[4] ..... H01H 35/34

[52] U.S. Cl. ..... 200/83 P; 200/81.5; 200/83 Q; 92/5 R

[58] Field of Search ..... 116/268; 73/717, 723, 73/745; 340/626; 91/400, 1; 92/5 R, 7; 200/81 R, 81 H, 81.5, 83 R, 83 J, 83 S, 83 P, 83 Q, 83 Z

[56] References Cited

U.S. PATENT DOCUMENTS

| | | | |
|---|---|---|---|
| 3,326,089 | 6/1967 | Machado | 92/5 R |
| 3,648,568 | 3/1972 | Wright | 92/5 R |
| 3,875,358 | 4/1975 | Willcox | 200/83 S |
| 4,084,671 | 4/1978 | Ternehall | 92/5 R |
| 4,200,775 | 4/1980 | Bodnar | 200/83 WM |
| 4,500,760 | 2/1985 | Malbec | 200/83 Z |

*Primary Examiner*—G. P. Tolin

*Attorney, Agent, or Firm*—Wood, Dalton, Phillips, Mason & Rowe

[57] ABSTRACT

A pressure switch including a housing 10, electrical contacts 16, 24 within the housing and a lever 26 movably mounted within the housing and operable to effect relative movement between the contacts. A biasing spring 70 biases the lever in a first direction and is settable through elements 74, 76, 78, 80 to determine the pressure level at which the switch will operate. An over center device 36, 38, 40, 42, 44, 46, 50, 52, 54, 56, 58 is located within the housing and is connected to the lever to provide snap action movement of the contact. A pressure port 96 is located in the housing and a fluid motor including a rolling diaphragm 116 is in fluid communication with the pressure port and acts in opposition to the biasing spring 70.

11 Claims, 5 Drawing Figures

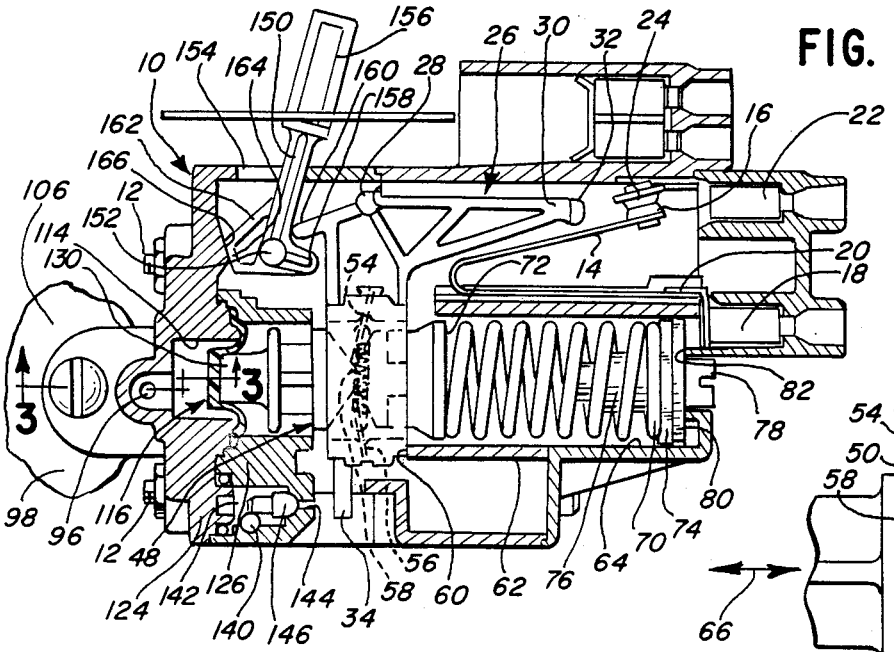
FIG. 1
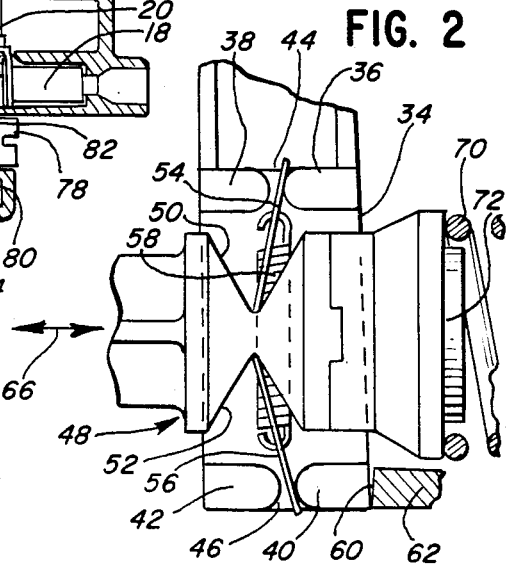
FIG. 2
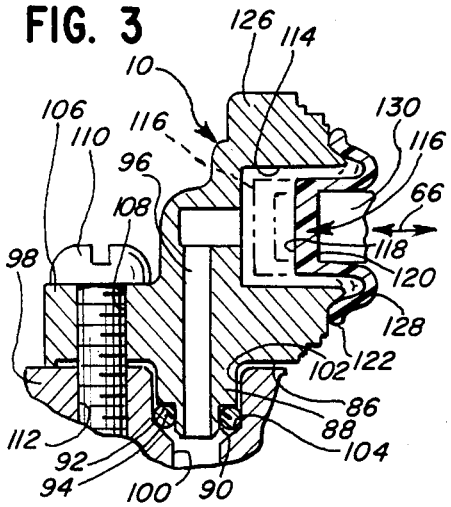
FIG. 3
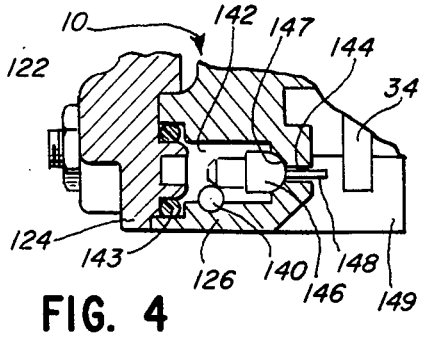
FIG. 4
FIG. 5
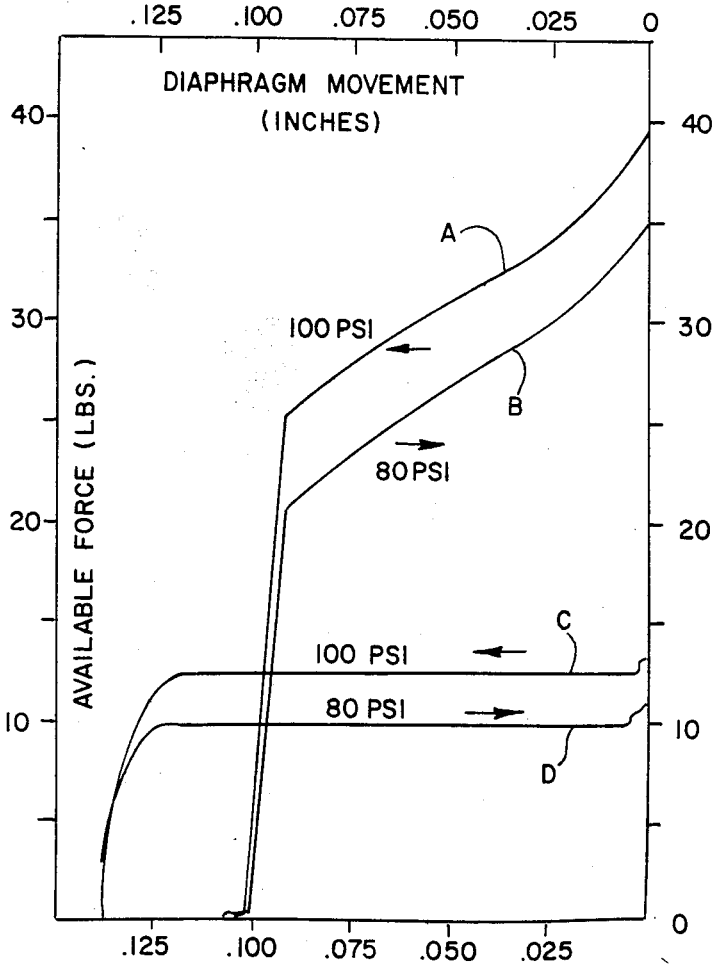

PRESSURE SWITCH WITH ROLLING DIAPHRAGM

FIELD OF THE INVENTION

This invention relates to pressure operated control apparatus, and more particularly, to a pressure operated electrical switch.

BACKGROUND OF THE INVENTION

There are any number of applications involving the handling of pressurized fluids, particularly gases, wherein pressure within the system requires monitoring for any of a variety of reasons. The apparatus utilized to monitor the system pressure may cause operational changes in the system as the pressure varies one value to another or from one range to another.

A common example of such a system is an air compressing system. Typically, a positive displacement apparatus such as a compressor is driven by an electrical motor to compress gas. Gas exiting the compressor is directed to a reservoir, typically in the form of a tank.

In controlling such an apparatus, it is desirable to terminate operation of the electrical motor, and thus the positive displacement apparatus, when the pressure within the tank attains some predetermined level. As the pressurized gas is depleted from the tank through usage or the like, it is likewise desirable to reinitiate operation of the electrical motor. Usually, such reinitiation will come upon the sensing of a second pressure level which is less than the first which caused termination of the operation of the motor, but yet is sufficiently high so as to assure the presence of adequate compressed fluid within the tank.

To provide this measure of control, pressure responsive electrical switches have been utilized to respond to the pressure in the tank and interrupt or close an electrical circuit to the motor that drives the positive displacement apparatus. Examples of electrical switches proposed for the purpose may be found in the following, commonly assigned, U.S. Pat. Nos.: 3,875,358 issued Apr. 1, 1975 to Willcox and 4,200,775 issued Apr. 29, 1980 to Bodnar.

Not untypically, a generally planar or so-called "flat" diaphragm will be associated with a pressure port. The position of the center of the diaphragm will vary proportionally to the pressure applied to the port and such a change of position is mechanically converted into motion sufficient to open or close electrical contacts at desired pressure levels.

While such switches work extremely well for their intended purpose and are highly reliable, the use of a flat diaphragm provides some difficulty in achieving good control of the pressure levels at which switching is to occur. In particular, in order for a flat diaphragm to move from one position to another, it becomes internally stressed and the internal stresses resist such movement. Consequently, the greater the pressure applied to such a diaphragm, the greater the internal resistance generated within the diaphragm itself tending to resist movement responsive to the pressure.

Furthermore, the very nature of a flat diaphragm is such that the limits of its stroke are relatively small or else rupture would occur. As a consequence of these characteristics, much care must be taken during manufacture to assure the components associated with the diaphragm rather closely hold tolerance or else the switch will be incapable of reliably operating within the intended range.

Furthermore, flat diaphragms are frequently undesirable from the applications standpoint. In particular, in order to obtain the necessary stroke of the center of the diaphragm sufficient to reliably operate other switch components, it is necessary that the diaphragm have a sufficiently large diameter as to allow such stroke without rupture. As a practical matter, this has frequently led to switches that are larger in size than would be desired because of the size limiting factor of diaphragm diameter.

Another difficulty encountered with the use of existing pressure switches resides in the need to use plumbing components such as tubes, couplings, elbows, etc. to connect the switch to the system in which it is to be employed. In a like vein, many pressure switch constructions currently in use have a great number of individual components. Because of this, assembly time is increased and reliability can be adversely affected.

The present invention is directed to overcoming one or more of the above problems.

SUMMARY OF THE INVENTION

It is the principal object of the invention to provide a new and improved pressure switch. More specifically, it is an object of the invention to provide a new and improved pressure switch that is free from various difficulties heretofore associated with pressure switches.

An exemplary embodiment of a pressure switch made according to the invention achieves the foregoing objects in a structure including a housing. Electrical contacts are disposed within the housing and are movable relative to each other between opened and closed positions. A pressure port is located in the housing for connection to a source of fluid under pressure to be monitored and a pressure responsive fluid motor is disposed within the housing and includes a cup-shaped rolling diaphragm having a convex side in fluid communication with the pressure port, an opposite concave side defining a hollow of variable size, an output element received in the hollow and a perimetrical edge secured within the housing. Also contained within the housing is a biasing means which is operative to act in opposition to the pressure applied to the concex side of the diaphragm. Means are provided to connect the fluid motor and the biasing means to the contacts such that movement of former will operate to move the latter between opened and closed positions.

As a consequence of this construction, the only forces generated in the diaphragm are those required to cause the sides of the same to roll as the diaphragm moves within the housing. These forces are essentially constant irrespective of input pressure and are relatively low at all times. Consequently, other components of the switch may be made with wider tolerances and still achieve the desired operating range with precision.

Furthermore, the use of the rolling diaphragm allows a diaphragm of considerably smaller diameter than the corresponding flat diaphragm to be used thereby providing a substantial size advantage.

The use of a rolling diaphragm also allows an increase in stroke of the diaphragm over the intended range of operational pressures which further minimizes the need for close tolerances in system components.

In a preferred embodiment, the output element is cylindrical and parts of the diaphragm roll along the cylindrical side of the output element.

The invention also contemplates the provision of a lever within the housing which is operable to effect relative movement between the electrical contacts. The lever is operated by an over center device which interconnects the biasing means and the fluid motor.

In a highly preferred embodiment, the housing has a flat face about the port. The pressure port is further surrounded by a boss having a first diameter and terminating in a reduced diameter end which is adapted to receive an O-ring seal. The invention contemplates a provision of a fastener receiving bore in the housing face immediately adjacent the boss. These features of the invention allow the switch to be assembled directly to a manifold for the fluid whose pressure is to be monitored without the need for intermediate plumbing fixtures or the like.

The invention also contemplates that the over center device include at least one slot in the lever and at least one groove in either the output element or the biasing means which is spaced from and face the slot. A leaf has one end disposed in the groove and an opposite end received in the slot. A spring biases the leaf into the groove. Positive over center, toggling action is provided by this construction.

Still another facet of the invention contemplates the provision of a lever pivoted within the housing which has a manually operable end extending externally of the housing. The lever also has an actuating end within the housing which in turn is operable to move the contacts between the opened and closed positions. The lever is formed of a resilient plastic and includes an integral finger or loop in engagement with an interior wall of the housing. The resiliency of the integral plastic finger causes the same to act as a return spring to bias the lever to a predetermined position with respect to the contacts.

Other objects and advantages will become apparent from the following specification taken in connection with the accompanying drawings.

DESCRIPTION OF THE DRAWINGS

FIG. 1 is a sectional view of a pressure switch made according to the invention;

FIG. 2 is an enlarged, fragmentary view of the interface of an output element, a biasing means, an over center device and an operating lever utilized in the switch;

FIG. 3 is an enlarged fragmentary section view taken approximately along the line 3—3 in FIG. 1;

FIG. 4 is an enlarged sectional view of an unloading valve; and

FIG. 5 is a graph comparing operational characteristics of a pressure switch made according to the invention with a pressure switch made according to the prior art and embodying a flat diaphragm.

DESCRIPTION OF THE PREFERRED EMBODIMENT

An exemplary embodiment of the invention is illustrated in the drawings and with reference to FIG. 1, is seen to include a housing, generally designated 10, which may be made of a number of components as illustrated and held together by through bolts 12 in any convenient fashion.

Within the housing 10 is a U-shaped spring 14 mounting an electrical contact 16 on one end and connected to a terminal 18 by means of a rivet 20 at its other.

A similar terminal 22 mounts, within the housing 10, a contact 24 in alignment with the contact 16. In the usual case, the internal resilience of the spring 14 will cause the contacts 16 and 24 to be in abutment with each other to establish an electrical connection between the terminals 18 and 22. In other words, the switch thus formed is of the normally closed variety.

To operate the switch, a lever in the form of a bellcrank, generally designated 26, is pivotally mounted within the housing 10. The bellcrank 26 may be formed of plastic and includes an integral pivot pin 28 which is received in a suitable recess (not shown) within the housing walls for journalling purposes. The bellcrank 26 also includes a first arm 30 terminating in an end 32 in close adjacency to the spring 14 such that when the bellcrank 26 is pivoted in a clockwise directed as viewed in FIG. 1, the end 32 will engage the spring 14 and move the same downwardly so as to move the contact 16 out of abutment with the contact 24 to thereby open the switch.

The bellcrank 26 includes a second arm 34 that is generally transverse to the arm 30. Intermediate its ends, the arm 34 includes a first set of oppositely facing posts 36 and 38 and, spaced therefrom a second set of similar posts 40 and 42. The posts 36 and 38, and the posts 40 and 42 are spaced from each other by slots 44 and 46 respectively.

An output element, generally designated 48, and to be described in greater detail hereinafter, extends freely between the first set of posts 36, 38 on the one hand and the second set of posts 40, 42 on the other. It includes oppositely opening, generally V-shaped grooves 50 and 52 which are nominally aligned with respective sets of the posts. Disposed within each of the grooves 50 and 52, and extending into the corresponding slot 44, or 46, is an associated metal leaf 54, 56. A tension coil spring 58 on one side of the output element 48 interconnects the leaves 54 and 56. This structure describes an over center or toggle mechanism to provide snap-action operation of the bellcrank 26.

In the position illustrated in FIGS. 1 and 2, the arm 34 of the bellcrank 26 is in abutment with a stop surface or end 60 of a wall 62 defining a spring chamber 64 within the housing 10. It is held in this position by the operation of the spring 58 attempting to collapse the leaves 54, 56 against the posts 36, 40.

The output element 48 is reciprocally movable in the direction indicated by an arrow 66 in FIG. 2. When the output element 48 is moved to the right as viewed in FIG. 2, because the arm 34 is bottomed out against the stop surface 60, the leaves 54 and 56 will begin to pivot about their points of contact with their respective grooves 50 and 52. This in turn will stretch the spring 58. Continued movement of the output element 48 to the right will ultimately result in the leaves 54 and 56 moving past center and as soon as that occurs, tension in the spring 58 will cause them to snap in their respective slots 44 and 46 against the posts 38 and 42 respectively. The resulting force applied to the arm 34 via the posts 38 and 42 will cause the bellcrank 26 to pivot in a clockwise direction to open the switch contacts 16, 24. The opened condition of the contacts will be maintained until the over center mechanism reassumes the configuration illustrated in FIG. 2. This will occur when the output element 48 moves to the left as viewed in FIG. 2 a sufficient distance to bring the leaves 54 and 56 back past center, at which time, stored tension within the spring 58 will result in the application of a force to the posts 36 and 40 and bring the arm 34 back in abutment with the stop surface 60.

A compression coil spring 70 is disposed within the spring chamber 64 and is in abutment with a shoulder 72 on one side of the output element 48. The opposite end of the spring 70 is in abutment with an enlarged head 74 on one end of an internally threaded sleeve 76. By any suitable means (not shown) the head 74 is keyed to one or more of the walls of the spring chamber 64 so as to prevent relative rotation between the sleeve 76 and the chamber 64.

A screw 78 is threaded into the sleeve 76 and includes an enlarged shoulder 80 abutting a stop surface 82 formed at the end of the spring chamber 64 opposite the output element 48. The screw 78 is rotatable within the spring chamber 64 and as a result, the axial position of the sleeve 76 within the spring chamber 64 may be moved as desired through suitable turning of the screw 78. Since the head 70 travels with the sleeve 76, this arrangement provides a means for adjusting the compressive force applied by the spring 70 to the output element 48.

As seen in FIG. 3, one side of the housing 10 has a relatively flat face 86. Projecting from the flat face 86 is a boss 88. The boss 88 terminates a section 90 of reduced diameter. Consequently, a shoulder 92 is formed and an O-ring seal 94 may be disposed thereon. Concentric with the section 90 and the boss 88 is an internal pressure port 96. The pressure port 96 is adapted to be placed in fluid communication with a source of fluid under pressure whose pressure is to be monitored. As illustrated in FIG. 3, such a source may be in a manifold shown fragmatically at 98 and having an internal fluid passage 100. The end of the passage 100 is slightly enlarged as at 102 and includes an internal chamfer 104.

As seen in FIGS. 1 and 3, in close adjacency to the pressure port 96, the housing 10 is provided with an ear 106 which in turn is provided with a bore 108 for receipt of a threaded fastener 110 which may be screwed into a threaded bore 112 in the manifold 98. Thus, it can be appreciated that by such means, the pressure switch of the invention can be directly mounted and sealed to a manifold or the like without the need for intervening plumbing. Consequently, assembly of equipment utilizing the pressure switch requires fewer operations since those associated with providing connecting plumbing are avoided. Furthermore, component parts are reduced to provide a considerable cost savings.

Returning to the pressure port 96, the same extends to a diaphragm chamber 114 within the housing 10. With the diaphragm chamber 114 is a rolling diaphragm 116, As is customary, the rolling diaphragm 116 is cup-shaped, having a convex surface 118 exposed to the pressure port 96 and an opposite concave surface 120. The rolling diaphragm 116 further includes a perimetrical edge 122 which is rolled back upon the convex surface 118 and captured in a sealed fashion between housing components 124 and 126. Thus, the perimetrical edge 122 is separated from the remainder of the diaphragm 116 by a reverse fold 128.

The convex side 118 of the diaphragm 116 provides a hollow of variable size which is generally cylindrical and which receives a cylindrical end 130 of the output element 48.

It will be recalled from a description of FIG. 2 that the output element 48 reciprocates in the direction of an arrow 66, which arrow is likewise shown in FIG. 3. In the case of the rolling diaphragm 116, as the cylindrical end 130 moves to the right as viewed in FIG. 3, the hollow receiving the end 130 becomes progressively smaller as the reverse fold 128 moves to the right and peels the diaphragm away from the surface 130. Conversely, when the cylindrical surface 130 moves to the left as viewed in FIG. 3, the concave surface 120 of the diaphragm 116 will be rolled onto the cylindrical surface with the hollow becoming larger.

It can be appreciated from the relationship of the biasing spring 70 to the diaphragm 116, the two act in opposition to one another. In other words, as pressure to the port 96 is increased, the output element 48 will be moved to the right and the cylindrical surface 130 likewise to the right. Conversely, as pressure decreases, stored energy within the spring 70 will cause leftward movement of such components, subject only to the restraint provided by resistance to tensioning of the spring 58 in the over center mechanism.

Where the switch is to be utilized in a compressor system, in many instances it is desired to release pressure from the compression chamber of the compressor at approximately the same time as the compressor is turned off through opening of the contacts 16 and 24. The purpose of such pressure release is to assure that there is no pressure loading against the compressor piston that would interfere with easy start up once the contacts 16 and 24 again reclose.

To this end, the housing 10 may be provided with a port 140 extending to an internal chamber 142 located in the housing part 126 as best seen in FIG. 4. The chamber 142 is closed by the housing part 124 and the interface of the housing parts 124 and 126 at the chamber 142 is sealed by an O-ring 143. The port 140 is adapted to be connected to the compression chamber of the compressor. The chamber 142 includes an outlet passage 144. A poppet 146 is located within the chamber 142 to seal against a seat 147 and normally closes the passage 144. A poppet actuator 148 extends through the passage 144 and is positioned to be engaged by the end of the arm 34 of the bellcrank 26 when the latter is pivoted in a clockwise direction about the pivot pin 28. Thus, when such occurs and the contacts 16 and 24 open to de-energize the compressor, the end 34 of the bellcrank 26 will engage the actuator 148 and move the same to the left as viewed in FIGS. 1 and 4. The poppet 146 will then be moved away from the seat 147. The passage 144 will then be unblocked and the compression chamber of the compressor will simultaneously be vented to atmosphere through an opening 149 in the side of the housing 10 and thereby conditioned for an easy start once the contacts 16 and 24 reclose.

In many instances, it is desired to provide a means for manually interrupting the system component being controlled by the switch, that is, to provide a means for manually overriding operation of the switch. The present invention includes such a means in the form of a lever 150 pivoted as at 152 within the housing. The lever 150 extends through an opening 154 in the housing and has a manual gripping portion 156 which may be grasped to move the lever 150 about the pivot 152.

Within the housing, the lever 150 includes a nose 158 engageable with an aligned nose 160 on the bellcrank 26. Thus, when the lever 156 is pivoted in a counter clockwise direction as viewed in FIG. 1, the nose 158 will engage the nose 160 to pivot the bellcrank 26 in a clockwise direction to open the contacts 16 and 24.

Preferably, the lever 150 is formed of a resilient plastic and includes an integral finger or loop 162 on the side thereof opposite the nose 158. A portion 164 of the loop is in engagement with a surface 166 on the interior of the housing 10 and the arrangement is such that when the lever 156 is pivoted in a counter clockwise direction, the engagement with the surface 166 will tend to cause the loop 162 to collapse. The inherent resilience of the plastic of which the lever 150 and the loop 162 are formed will tend to bias the lever 150 back toward the position illustrated in FIG. 1. In other words, the loop 162 acts as a return spring for the lever 150. Because the same is integrally formed as part of the lever 150, the use of a separate spring is avoided and the number of parts required to assemble the switch reduced.

Turning now to FIG. 5, some performance curves are illustrated. FIG. 5 graphs diaphragm movement in inches against the available force at the diaphragm for switch actuation. Curves A and B illustrate a conventional flat diaphragm pressure switch at 100 psi and 80 psi respectively while curves C and D similarly illustrate the same performance at the same pressures but for a rolling diaphragm such as that shown at 116.

In considering the curves illustrated in FIG. 5, one might consider that curves A and C show a pressure whereat it is desired to open the contacts 16 and 24 whereas curves B and D indicate pressures whereat it is desired to reclose the contacts 16 and 24. With such a consideration, it can be seen that the conventional, flat diaphragm apparatus moves approximately 0.025 inches with a force out change of approximately $1\frac{1}{2}$ pounds at a 30 pound level. In short, a relatively small, 5% change in force out to effect changing of the switch occurs as a consequence of a 20 psi change in input pressure to the switch. Furthermore, it will be observed that the available force for changing the switch varies proportionally to the diaphragm movement, decreasing with greater diaphragm movement.

In contrast, to effect the same change with a switch using a rolling diaphragm made according to the invention, a $2\frac{1}{2}$ pound difference in force out at a 10 pound level will be present which represents a 25% change in available force for operating the switch, as opposed to the the 5% change of the prior art device.

Because the prior art device must respond to a relatively small percentage change in available force, relatively tight tolerances must be held in its manufacture or else the same will not perform reliably. In contrast, the relatively large percentage change in available force required to effect the change of switch condition in a device made according to the invention allows more ready fabrication of the switch with greater tolerance and with a commensurate decrease in cost without sacrificing reliability. Indeed, reliability is improved. Furthermore, it will be appreciated that the available force for switch operation remains substantially constant over varying diaphragm displacement to further enhance predictability and reliability.

The use of the flat face 86 on the housing 10 along with the boss 88 and appurtenances thereto as previously described provides a further advantage in terms of the ease of mounting the pressure switch of the invention to a system requiring the same. In particular, and as noted previously, intermediate plumbing fixtures, and the time and expense of assembling the same are eliminated through the unique configuration of the boss 88 and associated fastener receiving gear 106.

Finally, the use of an integral spring in connection with the manual trip lever provides for ease of assembly and reduces the number of parts required in inventory in the course of manufacturing a pressure switch made according to the invention.

We claim:

1. A pressure switch including:

a housing;

electrical contacts within said housing and movable relative to each other between opened and closed positions;

a lever movably mounted within said housing and operable to effect relative movement between said electrical contacts;

biasing means within said housing and biasing said lever in a first direction, said biasing means being settable to determine the pressure level at which said switch will operate;

an over center device within said housing and connected to said lever to provide snap-action movement of said contacts between said opened and closed positions;

a pressure port in said housing for connection to a source of fluid under pressure to be monitored by said switch; and a pressure responsive fluid motor within said housing connected in opposition to said biasing means, said fluid motor comprising a cup-shaped rolling diaphragm having a convex side in fluid communication with said pressure port, an opposite concave side defining a hollow of variable size, an output element received in said hollow and connected to said lever, and a perimetrical edge secured within said housing;

said housing having a flat face and said port being located in said flat face, said port further being surrounded by a boss having a first diameter and terminating in a reduced diameter end adapted to receive an o-ring seal.

2. The pressure switch of claim 1 further including a fastener receiving bore in said face immediately adjacent said boss.

3. A pressure switch including:

a housing;

electrical contacts within said housing and movable relative to each other between opened and closed positions;

a lever movably mounted within said housing and operable to effect relative movement between said electrical contacts;

biasing means within said housing and biasing said lever in a first direction, said biasing means being settable to determine the pressure level at which said switch will operate;

an over center device within said housing and connected to said lever to provide snap-action movement of said contacts between said opened and closed positions;

a pressure port in said housing for connection to a source of fluid under pressure to be monitored by said switch; and a pressure responsive fluid motor within said housing connected in opposition to said biasing means, said fluid motor comprising a cup-shaped rolling diaphragm having a convex side in fluid communication with said pressure port an opposite concave side defining a hollow of variable size, an output element received in said hollow and connected to said lever, and a perimetrical edge secured within said housing;

said over center device being located between said biasing means and said output element and serving to connect the biasing means and the output element to said lever, said over center device comprising at least one slot in said lever, at least one groove in one of said output element and said biasing means spaced from and facing the slot, a leaf having one end in the groove and an opposite end received in said slot, and a spring biasing said leaf into said groove.

4. A pressure switch comprising:

a housing;

electrical contacts within said housing and movable relative to each other between opened and closed positions;

a bellcrank pivotally mounted within said housing and having one arm operable to effect relative movement between said electrical contacts;

biasing means within said housing and biasing the other arm of said bellcrank in a first direction, said biasing means being settable to determine the pressure level at which said switch will operate;

an over center device within said housing and connected to said other arm to provide snap action movement of said contacts between said opened and closed positions, said over center device including at least one slot in said other arm, at least one groove in an element connected to said biasing means, said groove being spaced from and facing said slot, a leaf having one end in the groove and an opposite end received in said slot, and a spring biasing said leaf into said groove;

a pressure port in said housing for connection to a source of fluid under pressure to be monitored by said switch, said port being located in a flat face on said housing and being surrounded by a boss having a first diameter and terminating in a reduced diameter end adapted to receive an O-ring seal.

a fastener receiving bore in said face immediately adjacent said boss; and a pressure responsive fluid motor within said housing connected in opposition to said biasing means via said element, said fluid motor comprising a rolling, cup-shaped diaphragm, having a convex side in fluid communication with said pressure port, an opposite concave side defining a hollow of variable size and receiving said element, and a perimetrical edge secured within said housing;

said element being generally cylindrical so that parts of said concave side of said diaphragm rollably embrace the cylindrical side thereof;

said diaphragm further including a movable reverse fold between said parts of said concave side and said perimetrical edge.

5. The pressure switch of claim 4 further including a lever pivoted within said housing and having a manually operable end extending therefrom and an actuating end within the housing and operable to engage said bellcrank and pivot the same to move said contacts, said lever being formed of a resilient plastic and including an integral finger in engagement with the interior of said housing to bias said lever to a predetermined position with respect to said bellcrank.

6. A pressure switch comprising:

a housing;

electrical contacts within said housing and movable relative to each other between opened and closed positions;

a lever pivotably mounted within said housing and having an arm operable to effect relative movement between said electrical contacts;

biasing means within said housing and biasing said lever in a first direction, said biasing means being settable to determine the pressure level at which said switch will operate;

a pressure responsive fluid motor within said housing and connected in opposition to said biasing means and operable in response to the receipt of fluid under pressure to move said lever to effect relative movement between said contacts; and a manual actuator pivoted within said housing including a manually operable end extending therefrom and an actuating end in proximity to said lever for engaging said lever and pivoting the lever to effect said relative movement between said contacts, said manual actuator being formed of a resilient plastic and including an integral finger or loop engaging the interior of said housing, a said finger or loop deflecting against said housing upon pivoting of said actuator to effect relative movement between said contacts and operable to bias said actuator to a predetermined position with respect to the lever upon release of said manually operable end.

7. The pressure switch of claim 6 wherein said lever is a bellcrank having a first arm operable to engage said contacts and a second arm associated with said fluid motor and said biasing means.

8. The pressure switch of claim 7 further including a valve chamber within said housing, an inlet to said valve chamber, an outlet from said valve chamber, a poppet within chamber and movable with respect to said outlet, a poppet actuator extending from said valve chamber into proximity with one of said arms and engageable thereby to effect relative movement between said poppet and said outlet upon pivotal movement of said bellcrank.

9. A pressure switch comprising:

a housing;

electrical contacts within said housing and movable relative to each other between opened and closed positions;

a lever pivotably mounted within said housing and having an arm operable to effect relative movement between said electrical contacts;

biasing means within said housing and biasing said lever in a first direction, said biasing means being settable to determine the pressure level at which said switch will operate;

a pressure responsive fluid motor within said housing and connected in opposition to said biasing means and operable in response to the receipt of fluid under pressure to move said lever to effect relative movement between said contacts; and a valve within said housing including an inlet adapted to be connected to a system to be vented, a vent from said housing, and a movable valve member controlling fluid communication between said inlet and said vent, said valve member being engageable by said lever and movable thereby as said lever effects relative movement between said contacts to establish fluid communication between said inlet and said vent.

10. The pressure switch of claim 9 wherein said valve member is a poppet and includes a poppet actuator extending through said vent and positioned to be engaged by said lever.

11. The pressure switch of claim 10 wherein said lever is a bellcrank having a first arm engageable with said contacts to effect relative movement between the same and a second arm operatively associated with said fluid motor, said biasing means and said poppet actuator.

* * * * *